US006248030B1

(12) United States Patent
Pierce

(10) Patent No.: US 6,248,030 B1
(45) Date of Patent: Jun. 19, 2001

(54) TENNIS NET REGULATING APPARATUS

(76) Inventor: Gordon N. Pierce, P.O. Box 1100, Pocasset, MA (US) 02559-1100

( * ) Notice: Subject to any disclaimer, the term of this patent is extended or adjusted under 35 U.S.C. 154(b) by 0 days.

(21) Appl. No.: 09/249,351

(22) Filed: Feb. 11, 1999

(51) Int. Cl.[7] ..... A63B 61/02; A63B 61/04
(52) U.S. Cl. ..... 473/493; 473/490
(58) Field of Search ..... 473/493; 43/7; 177/131

(56) References Cited

U.S. PATENT DOCUMENTS

| | | | | |
|---|---|---|---|---|
| 1,224,388 | * | 1/1917 | Lane | 473/493 |
| 1,632,553 | * | 6/1927 | Lane | 473/493 |
| 1,768,615 | * | 1/1930 | Lane | 473/493 |
| 2,586,245 | * | 2/1952 | McRae | 177/131 |
| 4,844,455 | * | 7/1989 | Funkhouser, Jr. | 473/493 |
| 5,215,310 | * | 6/1993 | Allbright | 473/493 |

OTHER PUBLICATIONS

Document AA the excerpt (pp. 153 & 154) from "*Tennis Courts, A Construction and Maintenance Manual*" was cited by the applicant in the application. Also included is an approval of The United States Tennis Court & Track Builders Association, granted to reprint those pages for resubmission of the above patent application.

* cited by examiner

*Primary Examiner*—Jeanette Chapman
*Assistant Examiner*—M. Chambers
(74) *Attorney, Agent, or Firm*—Thomas A. Kahrl. Esq.

(57) ABSTRACT

Apparatus for adjusting a tennis net of the kind that is supported by a cable or the like stretched between two supporting points, the apparatus comprising a tightening mechanism for adjusting the tension on the cable, and a tension indicator for sensing and giving an indication of the tension on the cable.

3 Claims, 4 Drawing Sheets

TENNIS NET REGULATING APPARATUS

BACKGROUND OF THE INVENTION

The present invention relates to regulating features of a post for tensioning a tennis net. More specifically the present invention is directed to a calibrated tensioning apparatus in combination with support post apparatus in combination with a tennis net that permit selectively setting characteristics of a tennis net for tournament and recreational play.

Tennis courts typically are equipped with a tennis net supported on a rope or cable stretched between two posts, at least one of which includes a cable tightening device such as a ratchet which are well known in the art. Positioning the height of the net has generally been accomplished by cranking the ratchet and engaging a cog. While such an arrangement is adequate to achieve a certain degree of repeatability of height setting, other factors contribute to variations in the setting of the net including stretch of the cable, moisture and player stretching the cable to lower the height of the net. The net result is that the net often is either too high or too low. In order to control this condition and achieve a more accurate setting and positioning of the net has led to the use of straps placed at the center of the net to fix the maximum height of the net.

Historically the game of tennis has been characterized by good manners. White attire was the rule of the day, and language and activity on the court were expected to be courteous. There was a time when the height and tension of a tennis net could be selected at the discretion of the players. More recently with the advent of tournaments intended to be viewed by large Television audiences rather club premises such as Longwood Mass or Merion Pa. with large tournament purses, tennis tournaments have been characterized by poor manners, adversarial behavior and worse language; the MACINROE effect in brief This has placed most rules in the zone of dispute, especially line calls and let calls leading to disputes or arguments between officials and players and also disputes between players themselves. Coincidentally the popularity of the game has been seriously eroded, in part in all probability due to this hassle factor.

The governing bodies of the Game of Tennis are well aware of the need to reestablish a sense of certainty and good order in the sport., Reference is made to the now pending rule changes before the ITF Tennis Commission. In brief the ITF now considers time is now right to implement a change to the Rules Of Tennis for the benefit of the game. In particular the ITF is considering implementing the so-called "No-Let" rule, that is Rule 14 is being considered for a change as set forth below;

Rule 14—The "Let" In Service-the ITF has under consideration an amendment to Rule 14 regarding abolition of the "Let" In Service. The rule currently provides;

"The Service is a Let:

a. If the ball touches the net, strap or bank, and is otherwise good, or, after touching the net, strap or band, touches the Receiver or anything which he wears or carries before hitting the ground.

b. If a Service or a fault is delivered when the Receiver is not ready (see Rule 12). In the case of a let, that particular service shall not count, and the Server shall serve again, but a service let does not annul a previous fault.

Report of the Rules of Tennis Commission

The possible abolition of the "Let" In Service has been considered for some years and been subject for discussion at the AGM both in 1996 and 1997. The main reasons have been and still are:

The abolition of the "Let" would reduce interruptions and make the game more continuous.

Also It would eliminate any disputes or arguments between officials and players and also disputes between players themselves. (It should be remembered that the great majority of all matches played worldwide at different levels are played without umpires).

It would for many tournaments save the costs of one official (of which tennis already have numerous).

It would eliminate the threat of injury to the net umpire who is located in a dangerous position.

Experiments with the abolition of the "Let" have been carried out quite successfiflly over two years in the lower divisions of the Davis Cup and in official ITF Junior team events. The great majority of the players very quickly adjusted to the new concept.

The Commission also feels that the abolition of the "Let" In Service would be an easy and logical step forward to develop the sport and that time is now right to implement this change to the Rules Of Tennis and therefore recommends acceptance of the amendment of the rule.

NOTE 1: All experiments carried out suggest that the "Lets" turn out some 65% neutral or playable, i.e. to no advantage to the Server or the Receiver, some 25% in favor of the Receiver.

Posts and Nets

The "Let" In Service. Trials at ITF events had shown that no significant advantage by server or receiver would result from the deletion of the let. Lax Kessler (USTA Technical Committee) recommended that a net tension specification be developed prior to the Let being dropped. Andrew Coe confirmed that this had been discussed at the previous days Technical Commission meeting, and it had been agreed to develop a test method and specification for net tension as a matter of urgency.

Speaking on behalf of the Industry, Dave Haggerty (Dunlop Slazenger) was greatly encouraged and excited that the ITF was proceeding to make such radical rule changes to promote the growth of the game and therefore providing exciting new opportunities for manufacturers. Rick Margin (Prince) agreed that these Rule amendments signaled an ability to modernize the game and suggested that there was perhaps an opportunity to publicize these proposals to the general public for the benefit of tennis.

Facilities. At the new ITF headquarters in Roshampton, London, a purpose-built laboratory has been created where the ITF can undertake research on products. Research will initially focus on balls and court surfaces, and then we intend to look at rackets and lighting in depth. The FIT in conjunction with the ISSS (a group of commercial laboratories who test court surfaces) is holding a seminar in Paris in May, looking at the technical aspects of court surfaces. It is the objective of the ITF Technical Commission to develop a classification system for tennis court surfaces, and other tennis court facilities, including engineering ball specifications to suit a particular court surface, also in conjunction with this, they will look at tennis shoe development, so we can have shoes to suit each specific surface.

The prior does not show the unique combination of a calibrated tensioning apparatus in combination with support post apparatus in combination with a tennis net that permit selectively setting characteristics of a tennis net.

SUMMARY OF THE INVENTION

The present invention relates to tension regulating features of a post for tensioning a tennis net. More specifically the present invention is directed to a calibrated tensioning apparatus in combination with support post apparatus and tennis net. that permit standardizing of characteristics of tennis net for tournament and recreational play. A general feature of the invention is the combination of a tightening mechanism for adjusting the tension on the cable, and a tension indicator for sensing and giving an indication of the tension on the cable, thus enabling the cable to be easily and accurately adjusted and readjusted to achieve and maintain a desired tension, assuring uniform playing characteristics over time for a given net, and from net to net.

Preferred embodiments of the invention include the following features:

The tension indicator has central feed screw apparatus on which is mounted a slideable guide, helical spring connected to a net cable or tightening and a tension indicator.. The spring element applies a measured transverse force on the cable which is opposed by a corresponding restoring force exerted by the cable (the magnitude of the restoring force is dependent on the tension on the cable); and the spring element responds to the combination of the transverse force and the restoring force. The tension indicator includes a display configured to be visible from the location where the cable is tightened. The display includes a scale indicating tension range, and ranges above and below a median range to permit selection of a specified setting. The display is mounted on the hook mechanism and is marked to show ranges of tension, the hook being fixed in relation to the tennis cable and the spring and indicator being free to move, scale being exposed for viewing a portion of said ranges at a given time, corresponding to the tension on the cable.

Other advantages and features will become apparent from the following description of the preferred embodiment, and from the claims.

The object of the patent being to provide for the means to regulate and establish specifications for tennis nets and to provide predictability and repeatability of interaction between a served ball and the net, particularly in view of the new proposed "no let" rule.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

BRIEF DESCRIPTION OF THE DRAWINGS

We first briefly describe the drawings.

DETAILED DESCRIPTION OF THE PREFERRED EMBODIMENT

Structure and Operation

Figure 1:
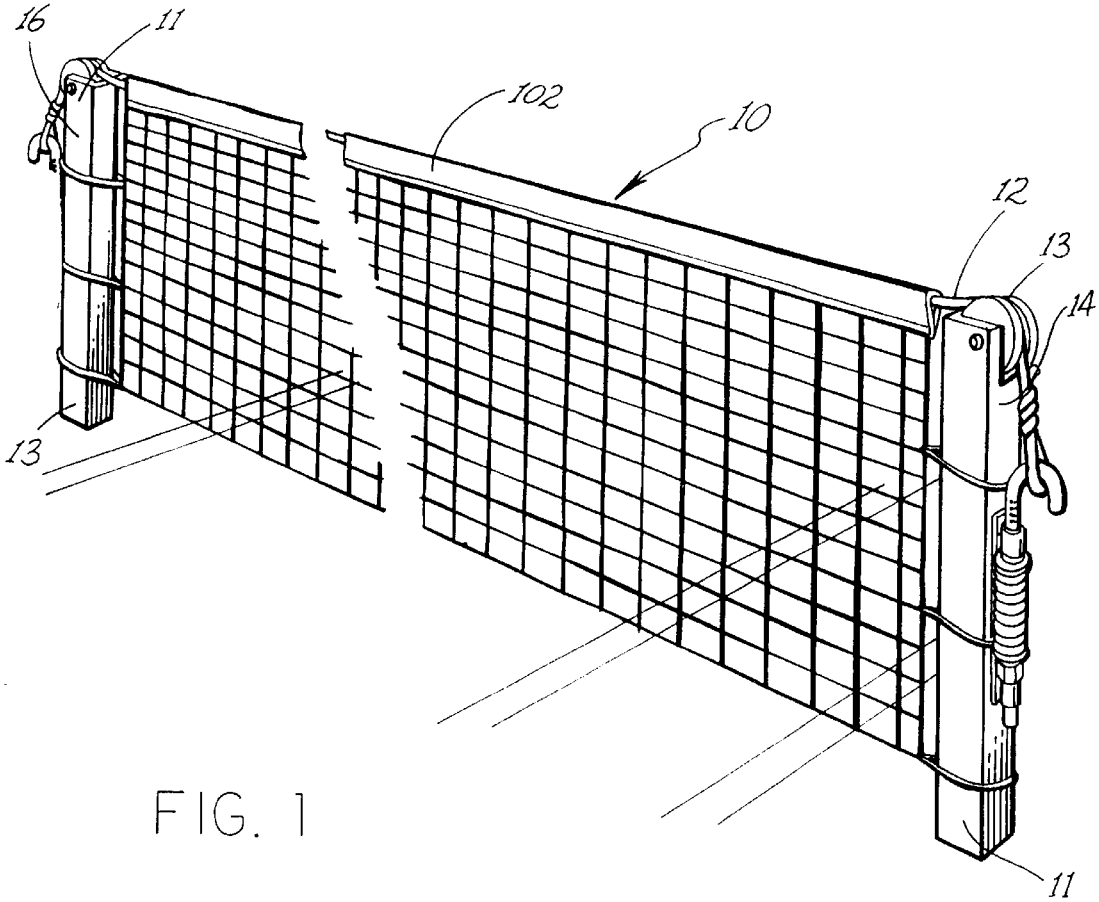
FIG. 1 is a partial perspective view of a tennis net strung between two support posts.
Figure 2:
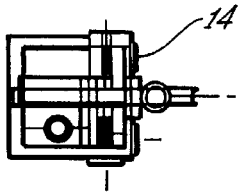
FIG. 2 is a top view, partly in section, of the top portion of the preferred embodiment of the invention.
Figure 3:
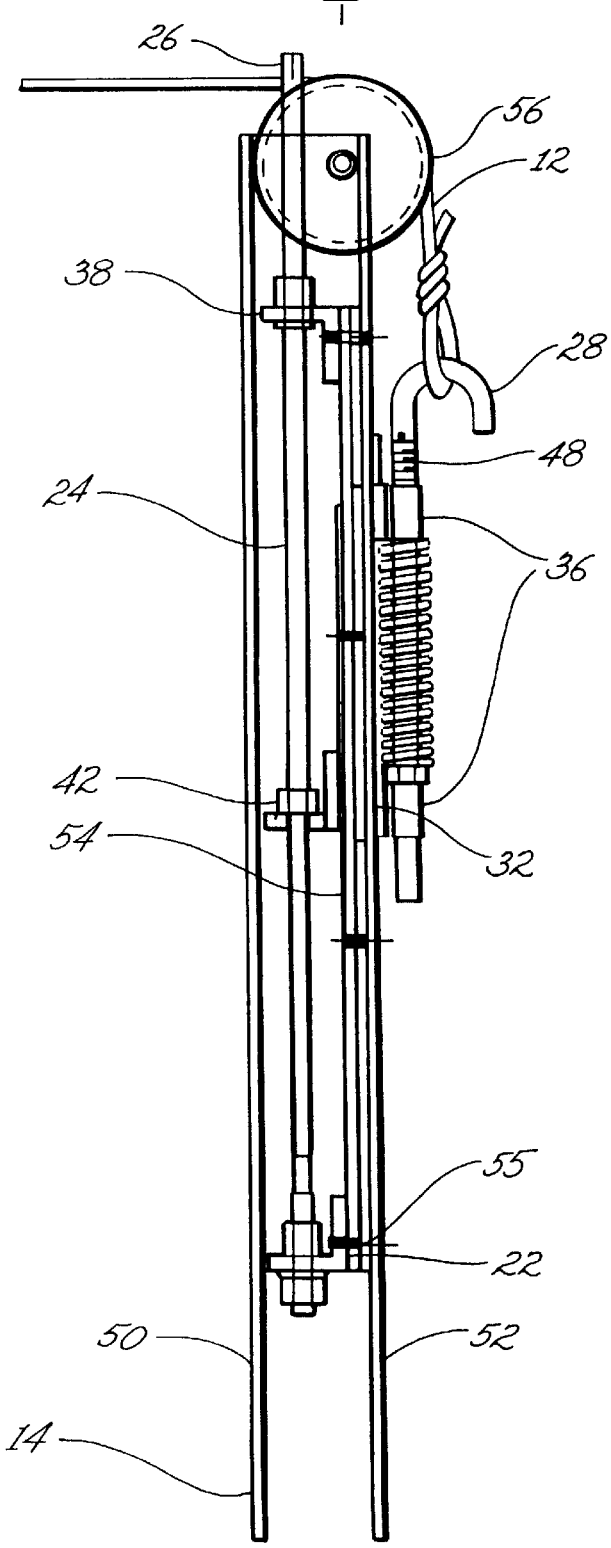
FIG. 3 is a side view, partly in section, of FIG. 2.

Referring to FIG. 1, a tennis net 10 is suspended on a cable 12 stretched between two points of support 11, 13 located respectively on a so-called active net post 14 and on a fixed net post 16. Mounted in post 14 is tension regulating assembly comprising a hook guide 18 having a tightening mechanism 30 as is shown in FIG. 3 of the kind having a moveable hook for supporting the cable 12 stretched between said two supporting net posts. The active net post 14 incorporates the tightening mechanism 30 along a central axis along which is slideable disposed a spring loaded hook guide 18 comprising an upper threaded guide 20 and a bottom support thrust bearing 22 positioned along the central axis of said net post. A elongated feed screw 24, having a square top end 26, a is rotably supported between said guide and thrust bearing. By rotating the feed screw 24 the spring loaded hook guide 18 selectively tightens said cable 12. A protective feature is included on the feed screw 24 comprising a thread interrupt which stops the threading action to prevent bottoming of the hook guide 18..Spring loaded hook guide 18 includes a hook 28 that engages the cable 12 with a hook slide 32 mounted on said feed screw. As is shown in FIGS. 3 and 7 hook 28 is surrounded by a helical spring 34 mounted between an upper guide member 36 and lower guide member 38 between two compression plates 40.

Figure 4:
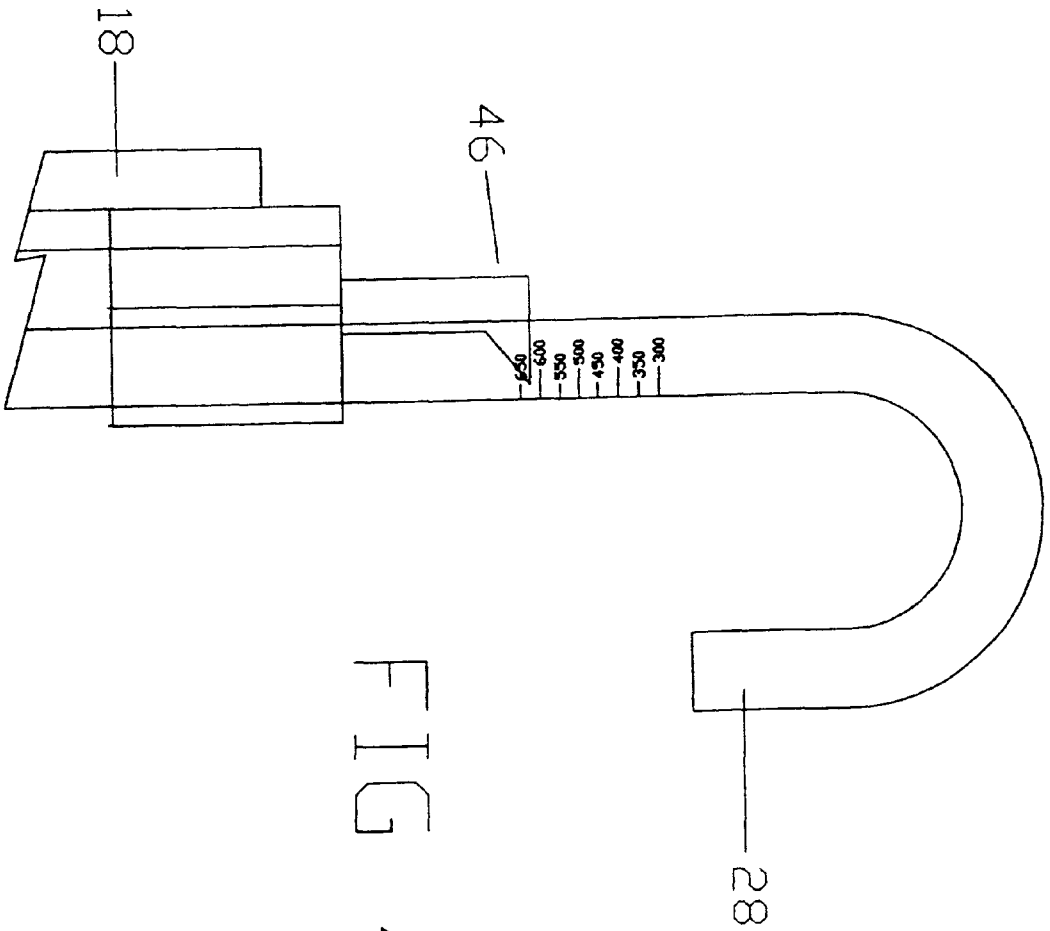
FIG. 4 is an exploded view of the tension indicator shown in FIG. 3.
Figure 5:
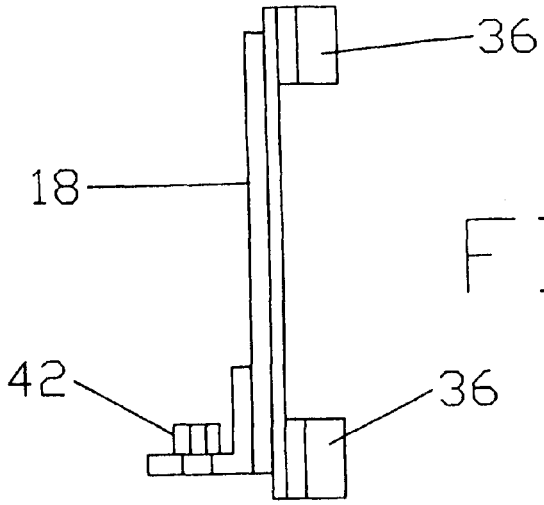
FIG. 5 is an exploded view of the hook guide of FIG. 3.
Figure 6:
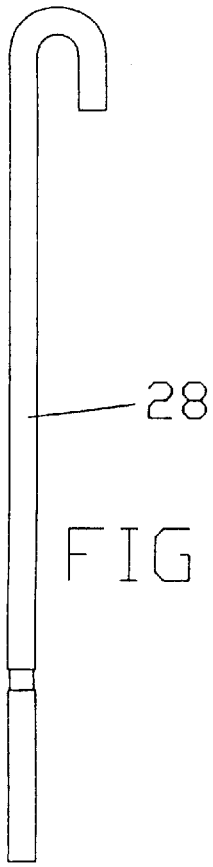
FIG. 6 is an exploded view of the hook of FIG. 3 showing the reduced diameter.
Figure 7:
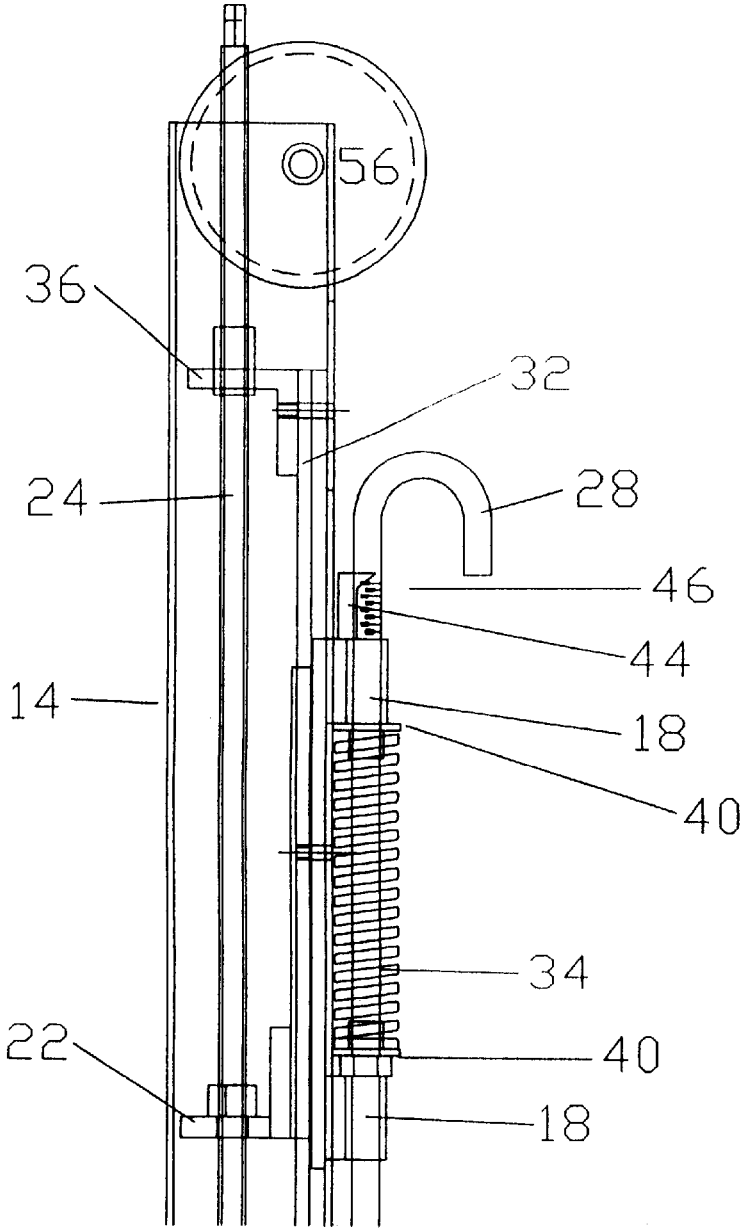
FIG. 7 is an expanded view of the hook guide assembly with the spring under compression.

As is shown in FIGS. 3 & 7 a pull nut 42 positioned on feed screw 24. Said nut is fixed to hook slide 32 causing said nut to travel in a reciprocal direction along feed screw 24 for adjusting the tension on said cable 12. Travel is between a first non compressed position shown in FIG. 3, to a selected compressed position shown in FIG. 7. In the compressed position spring 34 is compressed between upper thread guide 36 and said bottom support thrust bearing 22. Referring to FIGS. 3, 4 & 7 there is shown a tension indicator 46 for sensing and giving an indication of the tension on cable 12 having a pointer 44 and a scale 48.

As is shown in FIGS. 3 & 7 active net post 14 includes a plurality of walls including an inner wall 50 and an outer wall 52. Said outer wall includes longitudinal slot 54 associated with hook slide 32 for permitting mounting of the hook slide 32 in slideable engagement with the outer wall 52; wherein cable 12 and surrounding helical spring 34 are offset from the axis of the feed screw 24. As is shown in FIG. 3 anchor members 55 are provided for attaching the thrust bearing 22 to the outer wall 52

The center of net 10 is typically pulled down by a center strap, not shown, attached to a fitting mounted in the ground. The ends of cable 12 are held by posts 14, 16 and center strap in a manner (described below) that enables the tension on cable 12 to be selectively adjusted to and maintained at a predetermined level to assure uniform playing characteristics.

Referring to FIG. 3, one end of cable 12 enters the active net post 14 (made of square cross-section, through a slot 23 at the top of the post. Cable then passes over and is guided by a cylindrical cable roller 88 (which serves as support point 11, FIG. 1) to hook 28 with tension indicator assembly 46 thence to tightening mechanism 18. An annular groove 60 at the center of roller 28 guides cable 12. Tension is applied to cable 12 both by cranking the square top 26 with a wrench not shown for rotation of the tightening mechanism 18. The action of spring 34 actuates the tension indicator assembly 29. The measured tension is displayed by the combination of pointer 44 and scale 48 as is shown in FIG. 7. The end of cable 12 is held on hook 28 by passing the end over pulley 56. Cable 12 is tightened or loosened by turning a feed screw 24 that engages hook guide pull nut 42 coaxially attached to hook guide 18. Referring again to FIG. 3 and to FIGS. 4 and 7, pointer 44 of tension indicator assembly 29 is supported on hook guide assemble 18 for gauging the tension on the cable 12. The greater the tension on cable 12, supplied by the feed screw 24, the greater the downward force (FIG. 7), and hence the grater the compression of the spring mechanism 34. Thus the position of pointer 44 corresponds to the tension on cable 12 and is read off the scale 48.The tension could also be measured by a strain gauge mounted on a support associated with the tension adjusting mechanism.

Referring to FIG. 1 the upper edge of the net is ordinarily finished by a binding or finishing member 100 which may be formed of a strip of fabric folded on itself. Cable 12 is positioned within the space enclosed by the finishing member. Variation of the fabric of finishing member 100 can affect the action of a ball in no-let play and can and should be adjustable according to the new rules. Accordingly the net includes a changeable finishing member. 102 The tensioning devices of the invention are also useful for other types of athletic nets.

What is claimed is:

1. In combination, an active tennis net post and calibrated tensioning apparatus for selectively setting characteristics of a tennis net for use in "No Let" tournament and recreational play, said apparatus comprising:

a) said active net post having a central axis and comprising a hollow rectangular cross section, a plurality of walls, one wall of which includes an inner wall and an outer wall, said outer wall having longitudinal slot means associated with said slide guides for permitting mounting of a hook slide in slideable engagement with the outer wall wherein the cable and surrounding spring are off set from the axis of the drive screw;

b) a calibrated tightening apparatus for selectively setting characteristics of a tennis net for use in "No Let" tournament and recreational play having an inner member and an external member;

c) said inner member comprising;

i) an upper threaded guide and a bottom support thrust bearing positioned along the central axis of the net post; and ii) an elongated feed screw rotatably supported between said guide and thrust bearing; for threadably engaging an off-set hook slide;

d) said external member comprising;

i) means for selectively calibrating said cable comprising an offset hook slide mounted on said feed screw comprising a hook for engaging one end of said net cable surrounding a helical spring mounted between an upper guide member and lower guide member and a pull nut positioned on said feed screw;

ii) means for capturing said pull nut causing said nut to travel between a first non-compressed position to a selected compressed position between said upper thread guide and said bottom support thrust bearing in a reciprocal direction along said feed screw said for adjusting the tension on and calibrating said cable, and (iii) an external calibrated tension indicator for sensing and giving an indication of calibration selectively and setting characteristics of said net and cable and to provide predictability and repeatability of interaction between a served ball and the net, particularly in view of the new proposed "no let" rule.

2. The apparatus of claim wherein said tension indicator comprises an offset mechanism for applying a selected transverse force on said cable that is opposed by a corresponding restoring force exerted by said cable, the magnitude of said restoring force being dependent on said tension on said cable, and an offset tension sensor mounted externally of said active net post to respond to said transverse force and said restoring force.

3. The apparatus of claim 1 wherein said tension indicator includes external display for indicating said tension.

* * * * *